US011130340B2

(12) United States Patent
Ishizaki et al.

(10) Patent No.: US 11,130,340 B2
(45) Date of Patent: Sep. 28, 2021

(54) LIQUID DISCHARGE APPARATUS

(71) Applicant: Brother Kogyo Kabushiki Kaisha, Nagoya (JP)

(72) Inventors: Hirotoshi Ishizaki, Nagakute (JP); Takashi Omura, Inazawa (JP); Itsuki Morimoto, Ama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/813,254

(22) Filed: Mar. 9, 2020

(65) Prior Publication Data

US 2020/0290359 A1 Sep. 17, 2020

(30) Foreign Application Priority Data

Mar. 11, 2019 (JP) ..... JP2019-044036

(51) Int. Cl.
*B41J 2/165* (2006.01)

(52) U.S. Cl.
CPC ..... *B41J 2/16523* (2013.01); *B41J 2/16538* (2013.01)

(58) Field of Classification Search
CPC ..... B41J 2/16523; B41J 2/16538
See application file for complete search history.

(56) References Cited

U.S. PATENT DOCUMENTS 1,744,205 A * 1/1930 Boisseau ..... B41F 31/08 101/365
5,602,573 A * 2/1997 Waschhauser ..... B41J 2/16547 347/24
5,625,385 A 4/1997 Suzuki
8,061,802 B2 * 11/2011 Miyazawa ..... B41J 2/16547 347/30
2004/0119776 A1 6/2004 Nakamura
2009/0051731 A1 2/2009 Miyazawa
2011/0199425 A1 8/2011 Kaiho et al.
2011/0221821 A1 9/2011 Asano et al.

FOREIGN PATENT DOCUMENTS

EP 445526 A1 9/1991
JP 2006-096017 A 4/2006
JP 2011-183730 A 9/2011

OTHER PUBLICATIONS

Jul. 30, 2020—(EP) Extended EP Search Report—App 20162151.3.

* cited by examiner

*Primary Examiner* — Sharon Polk
(74) *Attorney, Agent, or Firm* — Banner & Witcoff, Ltd.

(57) ABSTRACT

A liquid discharge apparatus is provided including: a plurality of heads; and a maintenance unit movable in a first direction between a first position at which the maintenance unit faces the plurality of heads and a second position at which the maintenance unit does not face the plurality of heads, and configured to perform maintenance for the plurality of heads. The maintenance unit has a plurality of suction units corresponding to the plurality of heads, respectively, and a base unit to which the plurality of suction units are attached. The plurality of suction units includes a movable suction unit attached to the base unit so that, in a case that the maintenance unit is arranged at the first position, the movable suction unit is movable in a second direction, which crosses the first direction and which is a direction approaching closely to or separating away from the plurality of heads.

12 Claims, 8 Drawing Sheets

LIQUID DISCHARGE APPARATUS

CROSS REFERENCE TO RELATED APPLICATION

The present application claims priority from Japanese Patent Application No. 2019-044036 filed on Mar. 11, 2019, the disclosure of which is incorporated herein by reference in its entirety.

BACKGROUND

Field of the Invention

The present technique relates to a liquid discharge apparatus which discharges or jet a liquid, for example, an ink.

Description of the Related Art

Conventionally, an image forming apparatus is proposed. The image forming apparatus is provided with a head unit having a plurality of heads; and a maintenance unit having a plurality of cap mechanisms corresponding to the plurality of heads, respectively. The plurality of cap mechanisms move closely to the plurality of heads, respectively; each of the plurality of cap mechanisms sucks the liquid from one of the plurality of heads, and discharges or exhausts the liquid therefrom.

The above-described image forming apparatus needs to perform maintenance for all the plurality of heads even in a case that the maintenance is required to be performed for only a part the plurality of heads.

The present disclosure has been made in view of the above-described situation and an object of the present disclosure is to provide a liquid discharge apparatus capable of performing the maintenance only for a head, among the plurality of heads, for which the maintenance is required.

SUMMARY

A liquid discharge apparatus according to the present disclosure includes:

a plurality of heads configured to discharge a liquid;

a maintenance unit movable in a first direction between a first position at which the maintenance unit faces the plurality of heads and a second position at which the maintenance unit does not face the plurality of heads, and configured to perform maintenance for the plurality of heads, wherein the maintenance unit has a plurality of suction units corresponding to the plurality of heads, respectively, and a base unit to which the plurality of suction units are attached; and the plurality of suction units include a movable suction unit attached to the base unit so that, in a case that the maintenance unit is arranged at the first position, the movable suction unit is movable in a second direction, which crosses the first direction and which is a direction approaching closely to or separating away from the plurality of heads.

In the liquid discharge apparatus according to the present disclosure, it is possible to perform the maintenance only for a certain head, among the plurality of heads, for which the maintenance is required, by causing the movable suction unit to approach closely to the certain head.

DESCRIPTION OF THE EMBODIMENTS

Figure 1:
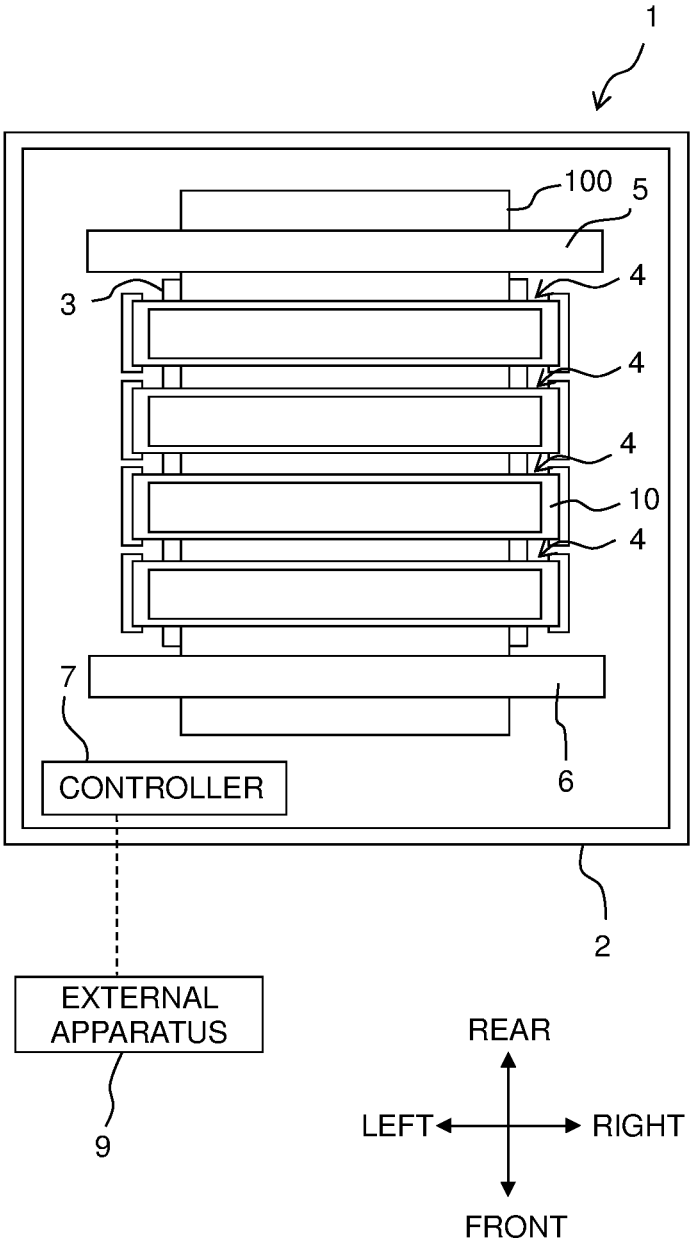
FIG. 1 is a plan view schematically depicting a printer.

In the following, the present disclosure will be explained, based on the drawings depicting a printer according to an embodiment of the present disclosure. FIG. 1 is a plan view schematically depicting a printer 1. In FIG. 1, a conveyance direction of recording paper 100 (recording medium) corresponds to a front-rear direction of the printer 1. Further, a width direction of the recording paper 100 corresponds to a left-right direction of the printer 1. Furthermore, a direction orthogonal to the front-rear direction and the left-right direction, namely, a direction orthogonal to the sheet surface of FIG. 1 corresponds to an up-down direction of the printer 1. The left-right direction corresponds to a first direction, and the up-down direction corresponds to a second direction.

As depicted in FIG. 1, the printer 1 includes a platen 3, four ink-jet heads 4, two conveying rollers 5 and 6, a controller 7, etc., which are accommodated in a casing 2.

The recording paper 100 is placed on the upper surface of the platen 3. The four ink-jet heads 4 are arranged side by side in the conveyance direction at a location above the platen 3. Each of the ink-jet heads 4 is a so-called line head. An ink is supplied to the ink-jet heads 4 from an ink tank 13 (see FIG. 3). Inks of different colors are supplied to the four ink-jet heads 4, respectively.

As depicted in FIG. 1, the two conveying rollers 5 and 6 are arranged respectively at the rear side and at the front side with respect to the platen 3. Each of the two conveying rollers 5 and 6 is driven by a non-depicted motor to convey the recording paper 100 on the platen 3 frontward.

The controller 7 includes an FPGA (Field Programmable Gate Array), an EEPROM (Electrically Erasable Programmable Read-Only Memory), a RAM (Random Access Memory), etc. Note that the controller 7 may further include a CPU (Central Processing Unit) or ASIC (Application Specific Integrated Circuit), etc. The controller 7 is connected with an external apparatus 9 such as a PC (Personal Computer), such that data can be communicated or transferred between the controller 7 and the external apparatus 9; the controller 7 controls the respective parts, components, units, etc., of the printer 1 based on print data sent from the external apparatus 9.

Figure 2:
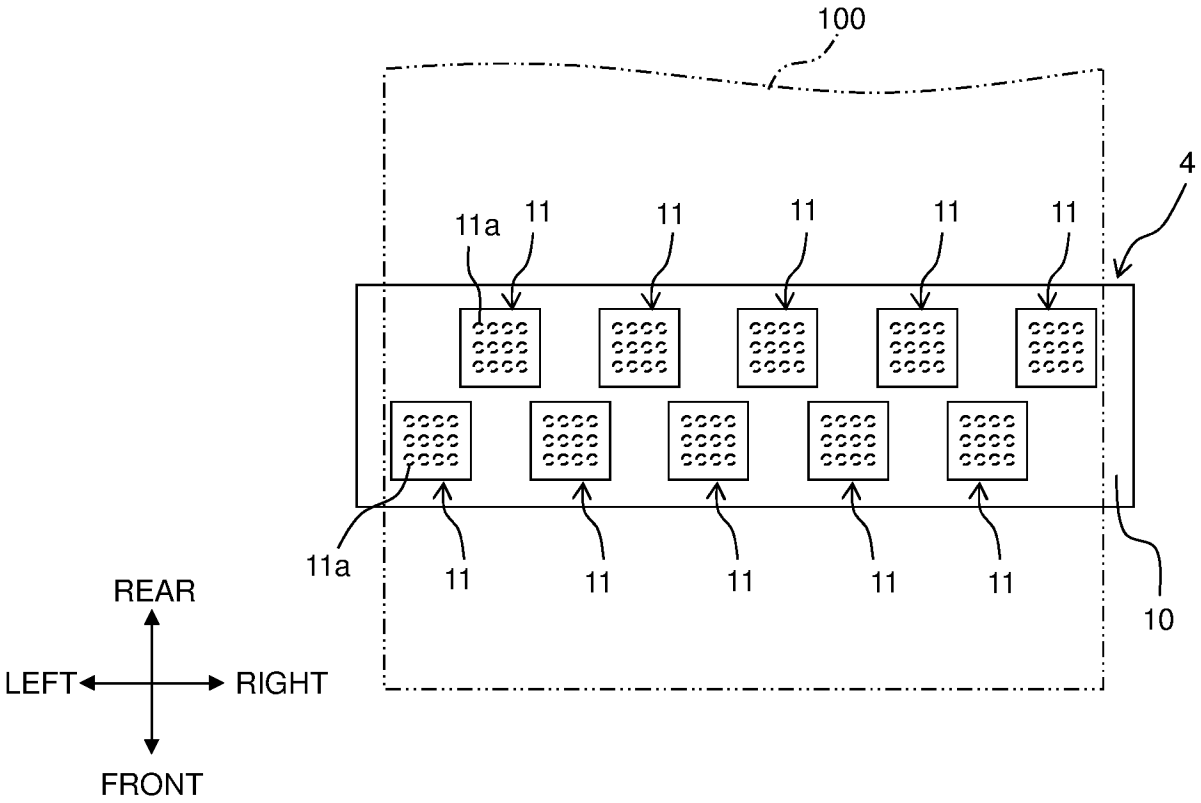
FIG. 2 is a plan view depicting an ink-jet head in a simplified manner
Figure 3:
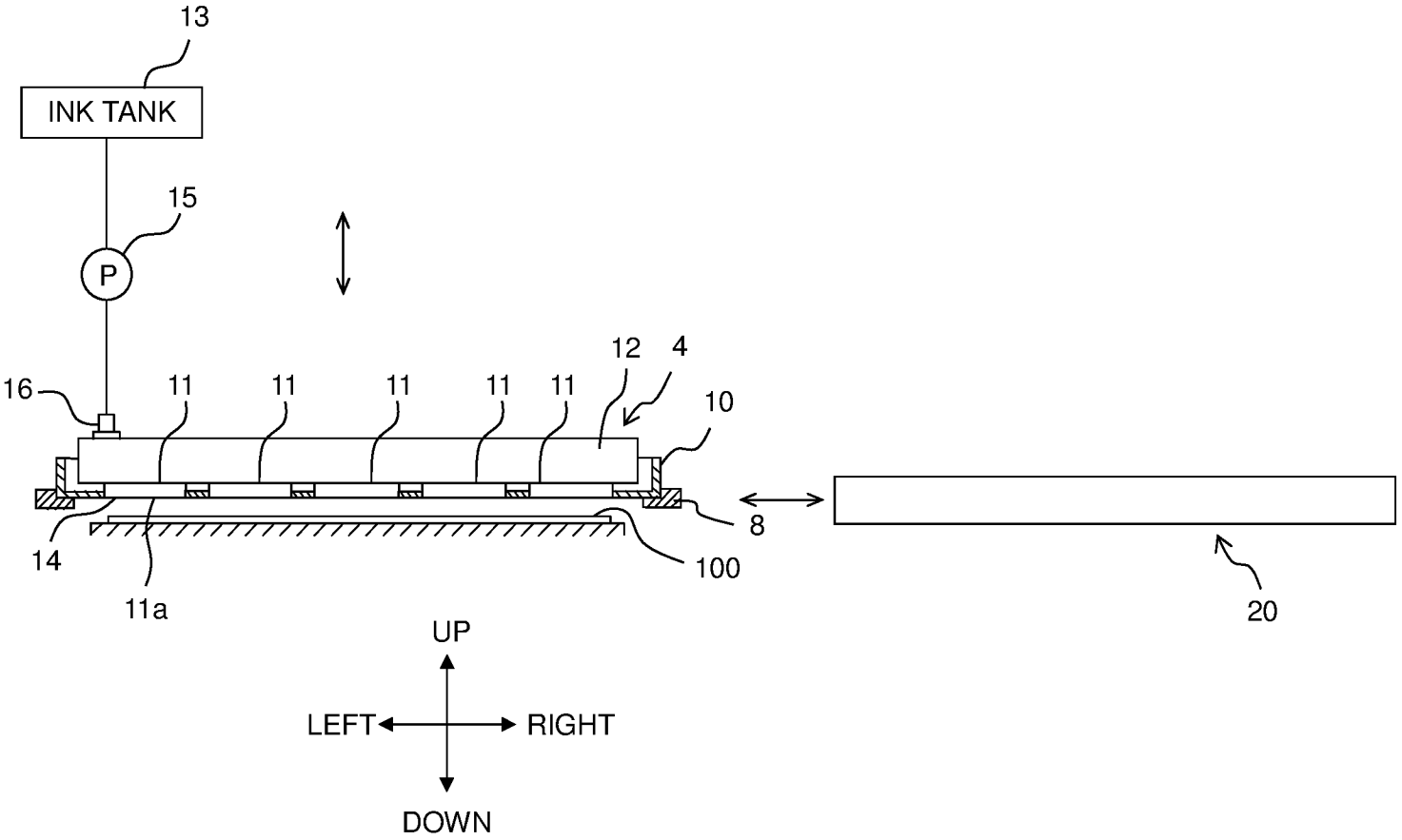
FIG. 3 is a cross-sectional view depicting the printer in a simplified manner

FIG. 2 is a plan view depicting an ink-jet head 4 in a simplified manner FIG. 3 is a cross-sectional view depicting the printer in a simplified manner As depicted in FIG. 2, each of the ink-jet heads 4 includes a holder 10 and a plurality of heads 11. The holder 10 has a shape of a rectangular plate which is elongated in the left-right direction. Further, the holder 10 holds the plurality of heads 11.

Each of the heads 11 has a plurality of nozzles 11 formed in the lower surface thereof. As depicted in FIG. 3, the plurality of nozzles 11 of each of the heads 11 are formed along the left-right direction which is a longitudinal direction of the ink-jet head 4. The plurality of heads 11 are arranged in a staggered alignment in the front-rear and left-right directions.

As depicted in FIG. 3, a reservoir 12 is arranged at a location above the plurality of heads 11. The reservoir 12 is connected to the ink tank 13 via a tube 16. A pressure pump 15 is provided on the tube 16. The reservoir 12 temporarily stores the ink supplied from the ink tank 13. A lower part of the reservoir 12 is connected to the plurality of heads 11. The ink is supplied from the reservoir 12 to the plurality of heads 11.

The controller 7 controls the motor which drives each of the two conveying rollers 5 and 6 so as to cause the two conveying rollers 5 and 6 to convey the recording paper 100 in the conveyance direction. Further, together with the above-described conveyance of the recording paper 100 by the conveying rollers 5 and 6, the controller 7 controls the four ink-jet heads 4 to discharge or jet the inks from the nozzles 11*a* toward the recording paper 100. With this, an image, etc., is printed on the recording paper 100.

As indicated by an arrow in FIG. 3, each of the plurality of ink-jet heads 4 is movable in the up-down direction. Note that in the following, the plurality of ink-jet heads 4 are referred simply to as the "ink-jet head 4" in some cases. The ink-jet head 4 is movable in the up-down direction, for example, by a ball screw mechanism. A maintenance unit 20 is arranged at a location on the right side of the ink-jet head 4. The maintenance unit 20 is movable in the left-right direction, and is movable between a right position and a left position. The right position is a position which is separated from the ink-jet head 4 to the right side, and which is a non-facing position at which the maintenance unit 20 does not face the ink-jet head 4. The left position is a position which is a position below the ink-jet head 4, and which is a facing position at which the maintenance unit 20 faces the ink-jet head 4. The left position corresponds to a "first position" of the present disclosure, and the right position corresponds to a "second position" of the present disclosure. The maintenance unit 20 is movable leftward and rightward (movable in the left-right direction), for example, by a ball screw mechanism.

Figure 4:
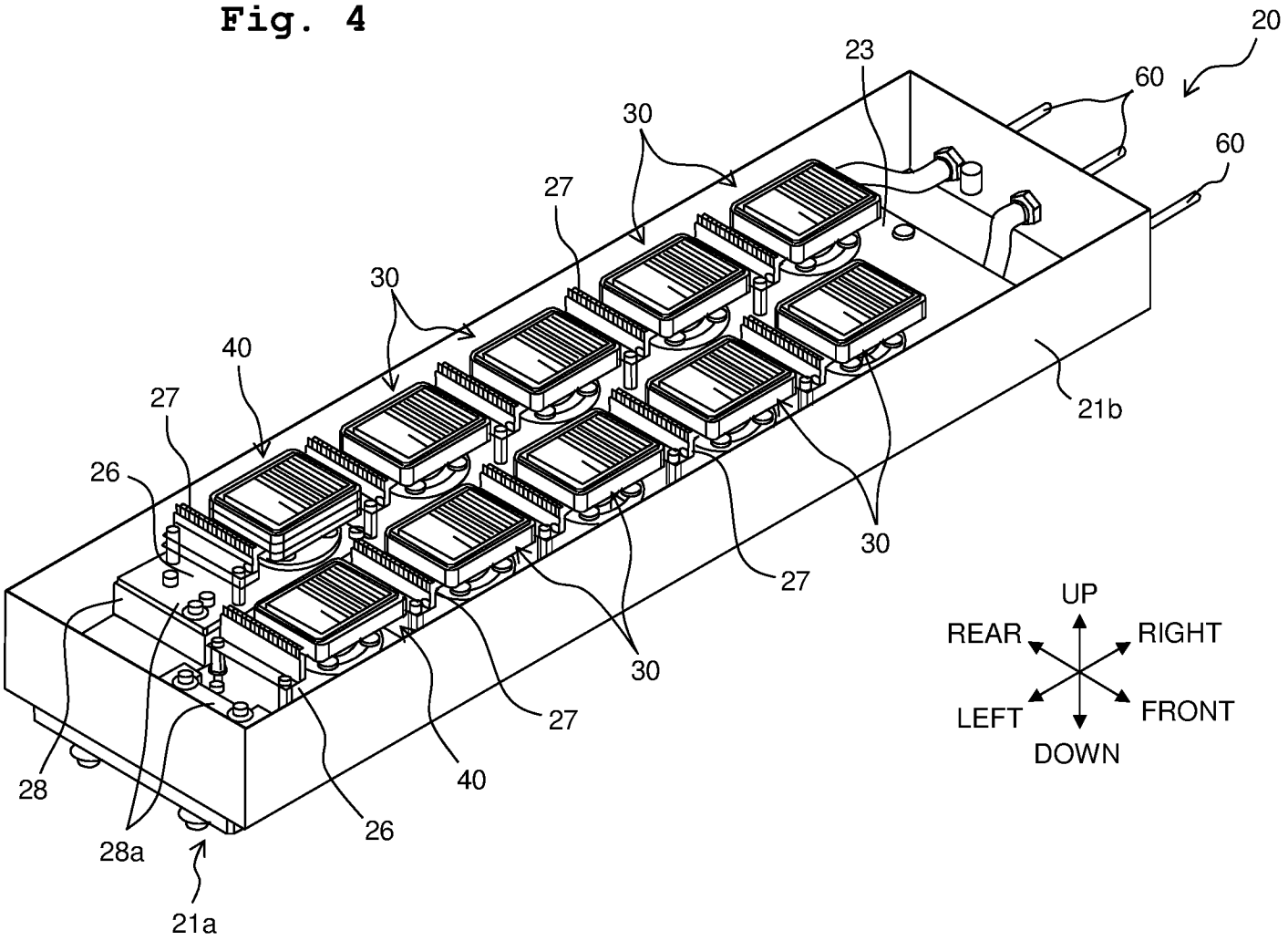
FIG. 4 is a perspective view of a maintenance unit.
Figure 5:
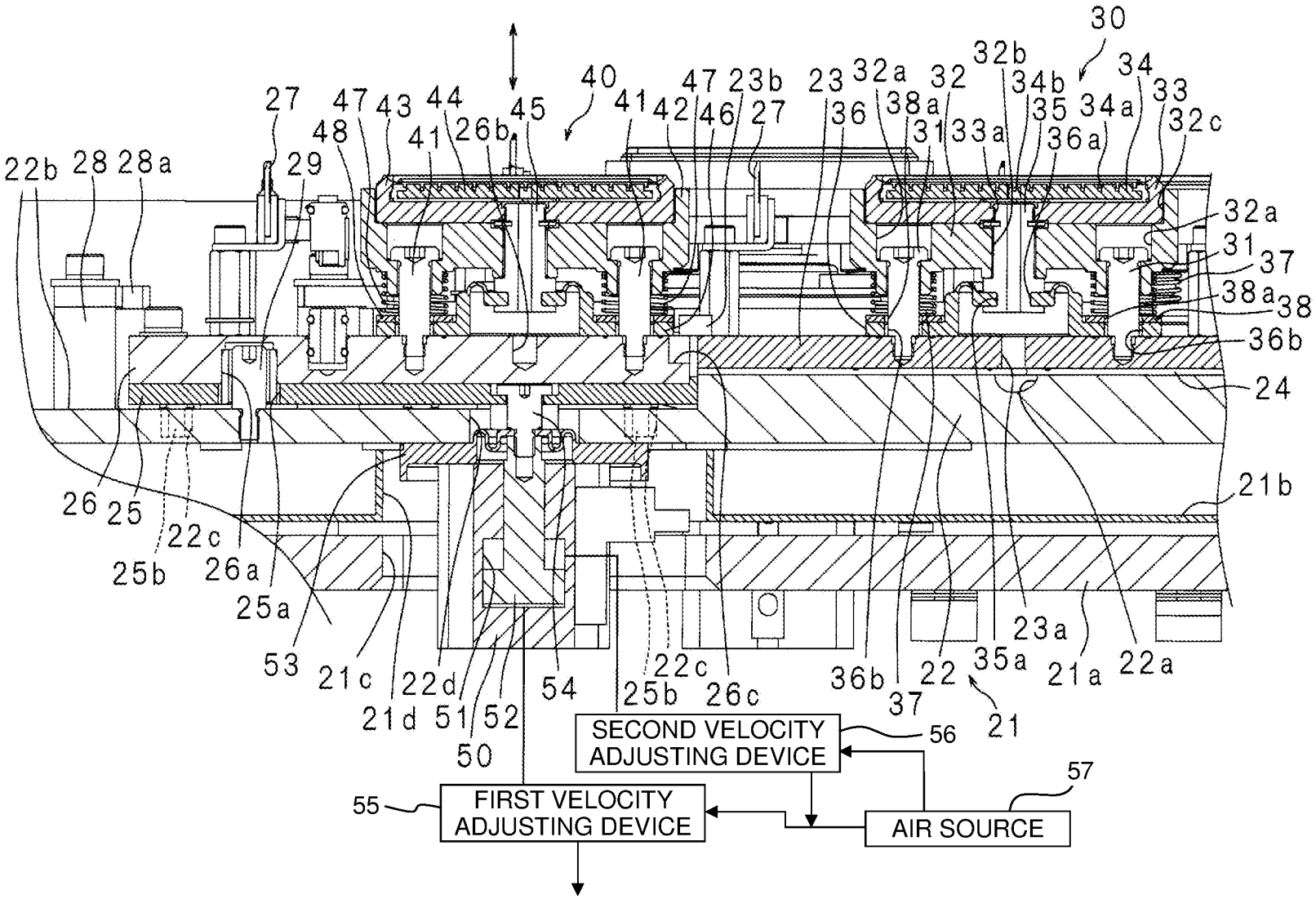
FIG. 5 is a partially enlarged view of the maintenance unit.

FIG. 4 is a perspective view of the maintenance unit 20, and FIG. 5 is a partially enlarged view of the maintenance unit 20. The maintenance unit 20 is provided with a base unit 21, a plurality (eight pieces in the present embodiment) of fixed suction units 30, and a plurality (two pieces in the present embodiment) of movable suction units 40. The base unit 21 has a base plate 21*a* which has a rectangular shape elongated leftward and rightward, an exhaust liquid pan 21*b* fixed at a location on the upper side of the base plate 21*a*, a bottom plate 22 arranged at a location on the upper side of the exhaust liquid pan 21*b*, and a top plate 23 arranged at a location on the upper side of the bottom plate 22.

The exhaust liquid pan 21*b* has a shape of a rectangular box, and is open in the upper surface thereof. The bottom plate 22 is supported at the inside of the exhaust liquid pan 21*b*. A recessed part 22*b* is formed at a left end part of the bottom plate 22. Two first attachment plates 25 and two second attachment plates 26 are provided on the recessed part 22*b*. The two second attachment plates 26 are arranged at locations on the upper side of the two first attachment plates 25, respectively. Namely, two pieces of a combination of the first and second attachment plates 25 and 26 are provided on the recessed part 22*b*. Although the first attachment plates 25 are connected to the second attachment plates 26, respectively, the first attachment plates 25 are not connected to the bottom plate 22. The two combinations of the first attachment plate 25 and the second attachment plate 26 are arranged side by side in the front-rear direction. The top plate 23 is fixed to a part, of the upper surface of the bottom plate 22, which is different from the recessed part 22*b*. The combinations of the first and second attachment plates 25 and 26 construct one plate, and an air cylinder 50 (to be described later on) is connected to this one plate.

The eight fixed suction unites 30 are fixed to the top plate 23. The two movable suction units 40 are fixed to the two attachment plates 26, respectively. Four pieces of the fixed suction unit 30 and one piece of the movable suction unit 40 are arranged side by side in the left-right direction so as to form one row (one array). The movable suction unit 40 is arranged on the leftmost end part of the row. In other words, the movable suction unit 40 is arranged on an end part, of the maintenance unit, which is close to the left position (first position) in the left-right direction. By arranging the movable suction unit 40 in the end part (an end part close to a print area), of the maintenance unit, which is close to the left position, the movable suction unit 40 is allowed to individually face any one of the plurality of heads 11 which are arranged in the row in the left-right direction, thereby making it possible to individually perform the maintenance for any one of the plurality of heads 11 which are arranged in the row in the left-right direction.

The eight fixed suction units 30 and the two movable suction units 40 form two rows (arrays), and the two rows are arranged side by side in the front-rear direction. The eight fixed suction units 30 and the two movable suction units 40 are arranged in a staggered manner. Wipers 27 are provided such that each of the wipers 27 is arranged between two fixed suction units 30 among the eight fixed suction units 30, between the fixed suction unit 30 and the movable suction unit 40, or on the left side with respect to the movable suction unit 40. Each of the wipers 72 wipes the nozzles 11*a*.

A liquid exhaust groove 22*a* is formed in the upper surface of the bottom plate 22. A seal member 24 is provided between the top plate 23 and the bottom plate 22, and in a fringe or peripheral part of the top plate 23. The seal member 24 prevents the liquid, which flows through the liquid exhaust groove 22*a*, from leaking therefrom. The top plate 23 is formed with a liquid exhaust hole 23*a* connected or continued to the liquid exhaust groove 22*a* and penetrating through the top plate 23 in the up-down direction.

The fixed suction units 30 are each provided at a location above the liquid exhaust hole 23*a*. Each of the fixed suction units 30 is provided with two shafts 31 which are arranged around (arranged in a location surrounding) the liquid exhaust hole 23*a*, and of which axial direction is the up-down direction. The shafts 31 are fixed to the top plate 23. A support frame 32 having a plate-like shape and configured to support a holding frame 33 (to be described later on) is provided on the shafts 31 so that the support frame 32 is movable in the up-down direction. The support frame 32 faces the top plate 23. The support frame 32 is formed with shaft-insertion holes 32*a* which penetrate through the support frame 32 in the up-down direction and in which the shafts 31 are inserted, respectively; and a tube-insertion hole 32*b* which penetrates through the support frame 32 in the up-down direction and in which a liquid exhaust tube 35 (to be described later on) is inserted. The diameter of an upper part of each of the shaft-insertion holes 32*a* is greater than the diameter of a lower part thereof; and the diameter of an upper part of each of the shafts 31 is greater than the diameter of a lower part thereof. Each of the shafts 31 is inserted into one of the shaft-insertion holes 32*a* from thereabove, and the upper part of each of the shafts 31 is locked on a stepped part of one of the shaft-insertion holes 32*a*.

The tube-insertion hole 32*a* and the liquid exhaust hole 23*a* are arranged substantially coaxially to each other. The liquid exhaust tube 35 is inserted into the tube-insertion hole 32*b*. The diameter of a lower part of the liquid exhaust tube 35 is greater than the diameter of an upper part thereof, and is greater than the diameter of the tube-insertion hole 32*b*. The liquid exhaust tube 35 is inserted into the tube-insertion hole 32*b* from therebelow, and the lower part of the liquid exhaust tube 35 is locked on a lower edge part of the tube-insertion hole 32*b*. The liquid exhaust tube 35 is fixed to the support frame 32. An attachment groove 35*a* configured to attach a seal member 36 (to be described later on) is formed in the liquid exhaust tube 35 at an outer circumferential surface of the lower part thereof.

A support recessed part 32*c* is formed in the upper surface of the support frame 32. A holding frame 33 is fit in the support recessed part 32*c*. The holding frame 33 has a tray-like shape, and is constructed of a flexible member. A peripheral part of the holding frame 33 is easily brought into tight contact with each of the heads 11 in a case that the holding frame 33 approaches closely to each of the heads 11. A central part of the holding frame 33 is formed with a through hole 33*a* penetrating therethrough in the up-down direction, and an upper end part of the liquid exhaust tube 35 is inserted into the through hole 33*a*. The upper end surface of the liquid exhaust tube 35 and the upper surface of the holding frame 33 are substantially flush with each other.

A liquid collecting plate 34 is held on the upper surface of the holding frame 33 having the tray-like shape. The upper surface of the liquid collecting plate 34 is formed with a conduction groove 34*a* which has a lattice-like shape and via which the liquid conducts. A central part of the liquid collecting plate 34 is formed with an exhaust hole 34*b* penetrating therethrough in the up-down direction, and connecting to the conduction groove 34*a*. The exhaust hole 34 and the liquid exhaust tube 35 are arranged coaxially to each other.

A seal member 36, configured to seal the lower part of the liquid exhaust tube 35 and a part or location surrounding the liquid exhaust hole 23*a* is provided between the support frame 32 and the top plate 23. The seal member 36 has a flexibility. The seal member 36 has a substantially circular shape in a plane view, and a central part of the seal member 36 projects upward. The central part of the seal member 36 has a bottomed cylindrical shape of which upper surface is the bottom surface. A first hole 36*a* is formed in the bottom surface of the bottomed cylindrical shape, and the lower end part of the liquid exhaust tube 35 is inserted into the first hole 36*a*. A peripheral part defining the first hole 36*a* is attached to the attachment groove 35*a* of the liquid exhaust tube 35. Two second holes 36*b* are formed in an outer circumferential part of the circular-shaped seal member 36; the shafts 31 are inserted in to the two second holes 36*b*, respectively.

A spring seat 38 having an annular ring shape is provided on an outer circumferential part of the upper surface of the seal member 36. The spring seat 38 is formed with two through holes 38*a* corresponding to the two second holes 36*b* of the seal member 36, respectively, and the shafts 31 are inserted into the two through holes 38*a*, respectively. A spring 37 is provided around each of the shafts 31, and is arranged between the spring seat 38 and the support frame 32. The spring 37 urges the support frame 32 upwardly. Note that it is allowable to use another urging member, for example, a rubber member, instead of using the spring 37.

In a case that the fixed suction unit 30 approaches closely to the head 11 and makes contact with the head 11, the peripheral part of the holding frame 33 is brought into tight contact with the head 11 due to the urging force of the spring 37. In a case that a suction pump 62 (see FIG. 6) is driven, the pressure in the liquid exhaust groove 22*a*, an inner space inside the liquid exhaust tube 35, the conduction groove 34*a*, the exhaust hole 34*b*, and a space between the holding frame 33 and the head 11 becomes a negative pressure, thereby allowing the liquid to be sucked from the head 11.

A second liquid exhaust hole 26*b* is formed in the second attachment plate 26. The second liquid exhaust hole 26 is connected to a liquid exhaust groove (omitted in the drawings) formed in the upper surface of the first attachment plate 25. Each of the movable suction units 40 is provided at a location above the second liquid discharge hole 26*b*. Each of the movable suction units 40 is provided with two shafts 41, a support frame 42, a holding frame 43, a liquid collecting plate 44, a liquid exhaust tube 45, a seal member 46, a spring seat 48, and a spring 47, the configuration thereof are similar to those of one of the fixed suction units 30. Accordingly, any detailed explanation therefor is omitted. Note that the seal member 46 of each of the movable suction units 40 seals a lower part of the liquid exhaust tube 45 and a part or location surrounding the second liquid exhaust hole 26*b*.

A guide pin 29 projecting upward is provided on the recessed part 22*b* of the bottom plate 22. A first insertion hole 25*a* is provided in the first attachment plate 25, penetrating through the first attachment plate 25 in the up-down direction; and a second insertion hole 26, having a bottomed cylindrical shape of which upper side is the bottom side, is provided in the second attachment plate 26. The guide pin 29 is inserted into the first insertion hole 25*a* and the second insertion hole 26, and guides a movement of the first attachment plate 25 and the second attachment plate 26 in the up-down direction.

Two support parts 28 projecting upward are provided on a left end part of the recessed part 22*a* of the bottom plate 22. Two stoppers 28*a* are provided on upper end parts of the two support parts 28, respectively. Each of the two stoppers 28*a* projects rightward from an upper end part of one of the support parts 28, and faces the second attachment plate 26 in the up-down direction. Each of the two stoppers 28*a* regulates movements in the upward direction of the first and second attachment plates 25 and 26. Each of the two stoppers 28*a* corresponds to a "first stopper" of the present disclosure.

A stepped part 26*c* having a stepped shape is provided on an upper right corner part of the second attachment plate 26. A stopper 23*b* is provided on a left end part of the top plate 23. The stopper 23*b* projects leftward from the top plate 23, and faces the stepped part 26*c* in the up-down direction. The stopper 23*b* regulates movements in the upward direction of the first and second attachment plates 25 and 26. The stopper 23*b* correspond to the "first stopper" of the present disclosure. The size in the up-down direction between the stepped part 26*c* and the stopper 23*b* are substantially same as the size in the up-down direction between of the second attachment plate 26 and each of the two stoppers 28*a*, and amount of the regulations performed by the stoppers 28*a* and 23*b*, respectively, are substantially same.

A plurality of insertion recessed parts 22*c* are formed in the recessed part 22*b* of the bottom plate 22. A plurality of stoppers 25*b* projecting downward are formed in the lower surface of the second attachment plate 26. The plurality of stoppers 25*b* are inserted into the plurality of insertion recessed parts 22*c*, respectively. The plurality of stoppers 25*b* regulate movements in the downward direction of the first and second attachment plates 25 and 26. Each of the plurality of stoppers 25*b* corresponds to a "second stopper" of the present disclosure.

Openings 21*c* and 21*d* are provided on the base plate 21*a* and the exhaust liquid pan 21*b*, respectively, at a location below each of the movable suction units 40; and an attachment hole 22*d* via which the air cylinder 50 is attached to the bottom plate 22 is provided on the bottom plate 22. A cylinder chamber 50 extending in the up-down direction is provided in the inside of the air cylinder 50. A rod 52 is provided in the cylinder chamber 51; an upper end part of the rod 52 projects, from the cylinder chamber 51, to the outside of the cylinder chamber 51. The air cylinder 50 and the rod 52 are inserted into the openings 21*c* and 21*d* of the base plate 21*a* and the exhaust liquid pan 21*b*, respectively, from therebelow, and an upper end part of the rod 52 is inserted into the insertion hole 22*d*. The upper end part of the rod 52 is connected to the first attachment plate 25 via a connecting member 54.

A sealing member (closing member) 53 is provided between the bottom plate 22 and the air cylinder 50. The sealing member 53 seals a part or location surrounding the attachment hole 22*d*, and prevents the liquid from leaking from the attachment hole 22*d*. The sealing member 53 seals a connecting part or location at which the air cylinder 50 and each of the movable suction units 40 are connected to each other. The sealing member 50 has a circular shape in a plane view, and a central part of the sealing member 50 is thin as compared with a peripheral part thereof, is formed to have a bellows-like shape, and is expandable and contractable in the up-down direction (axial direction of the air cylinder 50). The central part of the sealing member 50 is connected to the upper end of the rod 52. The peripheral part of the sealing member 53 is sandwiched between the peripheral part of the upper part of the air cylinder 50 and the peripheral part of the attachment hole 22*d*. Even in a case that the rod 52 moves in the up-down direction, the sealing member 53 is also expanded and contracted in the up-down direction, thereby making it possible to prevent the liquid from leaking from the attachment hole 22*d*. Note that the wiper 27 provided on the left side of each of the movable suction units 40 is fixed to the second attachment plate 26, and is moved in the up-down direction together with the second attachment plate 26.

A compressed air is supplied from an air source 57 to a lower part of the cylinder chamber 51 via a first speed regulator 55. The compressed air is supplied from the air source 57 to the lower part of the cylinder chamber 51 via a second speed regulator 56. The first speed regulator 55 and the second speed regulator 56 are, for example, speed regulating valves, respectively. Each of the speed regulating valves is capable of regulating the speed of the air exhausted from the cylinder chamber 51.

In a case that the compressed air is supplied from the first speed regulator 55 to the cylinder chamber 51, the air is exhausted from the second speed regulator 56, and the rod 52 is moved upward. By regulating the speed of the air exhausted from the second speed regulator 56, the speed of the upward movement of the rod 52 can be regulated. Namely, the operating speed of the air cylinder 50 can be regulated.

In a case that the compressed air is supplied from the second speed regulator 56 to the cylinder chamber 51, the air is exhausted from the first speed regulator 55, and the rod 52 is moved downward. By regulating the speed of the air exhausted from the first speed regulator 55, the speed of the downward movement of the rod 52 can be regulated. Namely, the operating speed of the air cylinder 50 can be regulated.

Note that it is allowable to omit the second speed regulator 56, and to provide an urging member, which is configured to urge the rod 52 downward, to an upper part of the cylinder chamber 51. In such a case, by regulating a supply speed of supplying the compressed air from the first speed regulator 55 to the cylinder chamber 51, it is possible to regulate the speed of upward movement of the rod 52.

Figure 6:
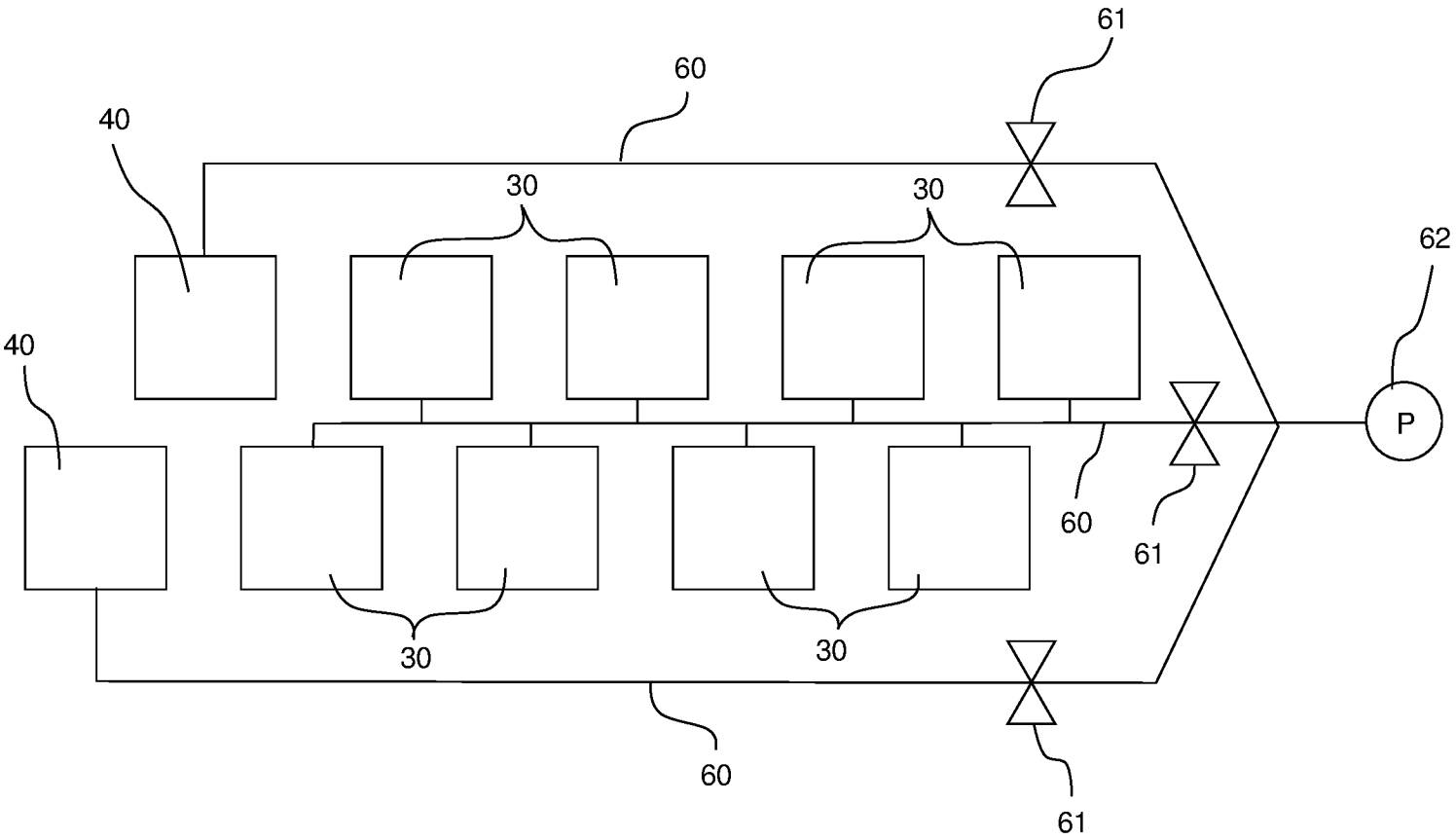
FIG. 6 is a piping diagram depicting a suction pump, a liquid drainage tube (liquid exhaust tube), a fixed suction unit and a movable suction unit.

FIG. 6 is a piping diagram depicting a suction pump 62, a liquid drainage tube (liquid exhaust tube) 60, the fixed suction units 30 and the movable suction units 40. In a case that the suction pump 62 is driven, the liquid is discharged or exhausted from each of the movable suction units 40 via the liquid exhaust groove and the liquid exhaust tube 60. Two pieces of the liquid exhaust tube 60 are used for the two movable suction units 40, respectively. In the case that the suction pump 62 is driven, the liquid is discharged or exhausted from each of the fixed suction units 30 via the liquid exhaust groove 22*a* and the liquid exhaust tube 60. One piece of the liquid exhaust tube 60 is used for the eight fixed movable suction units 30. Three on-off valves 61 are attached to the three liquid exhaust tubes 60, respectively. By opening/closing the respective on-off valves 61, exhaust of the liquid from any one of or both of the movable suction units 40, and/or exhaust of the liquid from the eight fixed suction units 30 are executed. Note that as depicted in FIG. 4, the second attachment plate 26 on the rear side and the liquid exhaust tube 60 on the rear side are connected to each other via a tube; the second attachment plate 26 on the front side and the liquid exhaust tube 60 on the front side are connected to each other via a tube; and the bottom plate 22 and the liquid exhaust tube 60 in the center in the front-rear direction are connected to each other via a tube. Namely, the three tubes are drawn or routed in the inside of the exhaust liquid pan 21*b*.

FIGS. 7A to 7D are explanatory views of a method for sucking the liquid from a predetermined head 11, among a plurality of heads 11, by the movable suction unit 40. As indicated by arrows in FIG. 7A, during the maintenance operation, the ink-jet head 4 is moved upward, and the maintenance unit 20 arranged at the right position is moved leftward in the left-right direction.

Figure 7A:
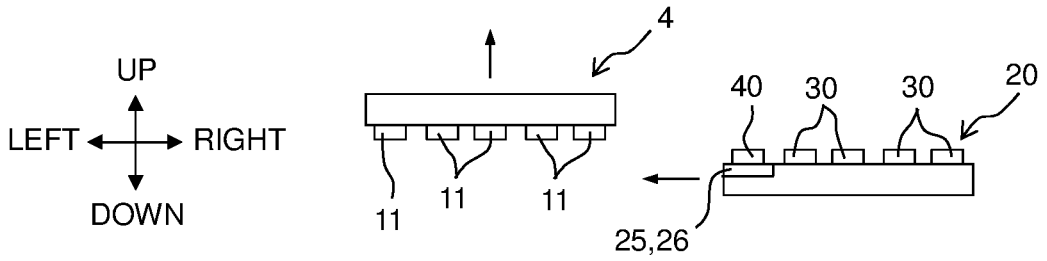
FIGS. 7A to 7D are explanatory views of a method for sucking a liquid from a predetermined head, among a plurality of heads, by the movable suction unit.
Figure 7B:
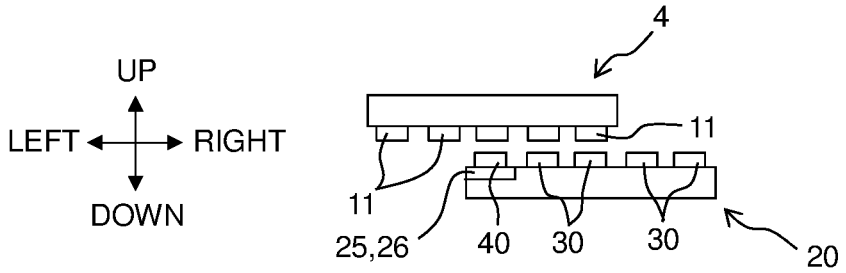

As depicted in FIG. 7B, the maintenance unit 20 is moved to a location below the ink-jet head 4 so that the movable suction unit 40 faces a head 11 which is included in the plurality of heads 11 and for which the maintenance is required (hereinafter referred also to a "maintenance target"). Namely, the maintenance unit 20 is arranged at the left position. In FIG. 7B, a head 11 which is located at the center in the left-right direction is the maintenance target. In this situation, none of the movable suction units 40 and none of the fixed suction units 30 make contact with the head 11 as the maintenance target.

Figure 7C:
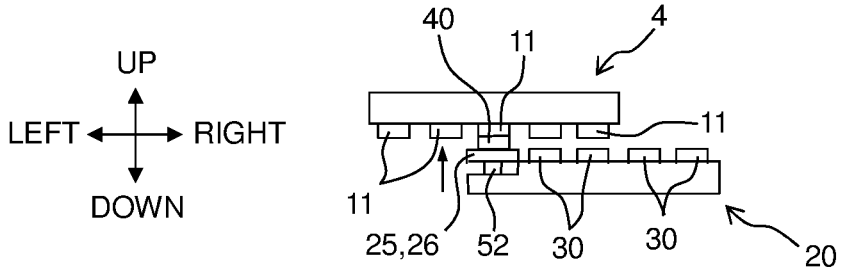
Figure 7D:
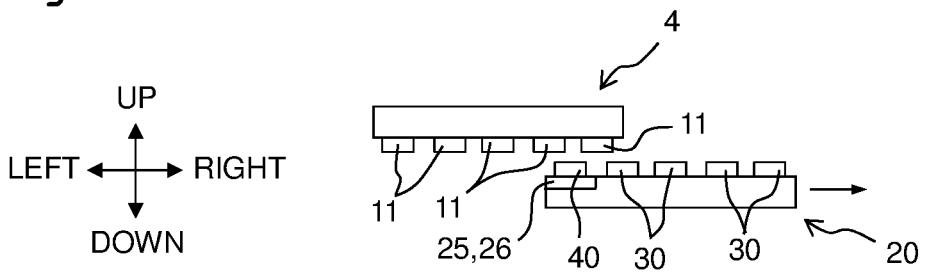

As indicated by an arrow in FIG. 7C, the air cylinder 50 is activated and only the movable suction unit 40 is moved upward and approaches closely to the maintenance target. The peripheral part of the holding frame 43 makes tight contact with the head 11; in a case that the suction pump 62 is driven, the pressure in the liquid exhaust groove, the internal space of the liquid exhaust tube 45, the conduction groove, the exhaust hole and the space between the holding frame 43 and the head 11 becomes a negative pressure, thereby allowing the liquid to be sucked from the head 11. Note that the movable suction unit 40 is moved upward immediately before the movable suction unit 40 faces the maintenance target, and the wiper 72 arranged on the left side of the movable suction unit 40 makes contact with the nozzles 11*a* of the maintenance target, and wipes the nozzles 11*b*.

After the liquid has been sucked, the air cylinder 50 is activated, and the movable suction unit 40 is moved downward and is separated away from the maintenance target. Then, as indicated by an arrow in FIG. 7D, the maintenance unit 20 is moved rightward in the left-right direction, and reaches the right position. In such a manner, the movable suction unit 40 makes contact only with the maintenance target, and performs the suction of the liquid.

Figure 8:
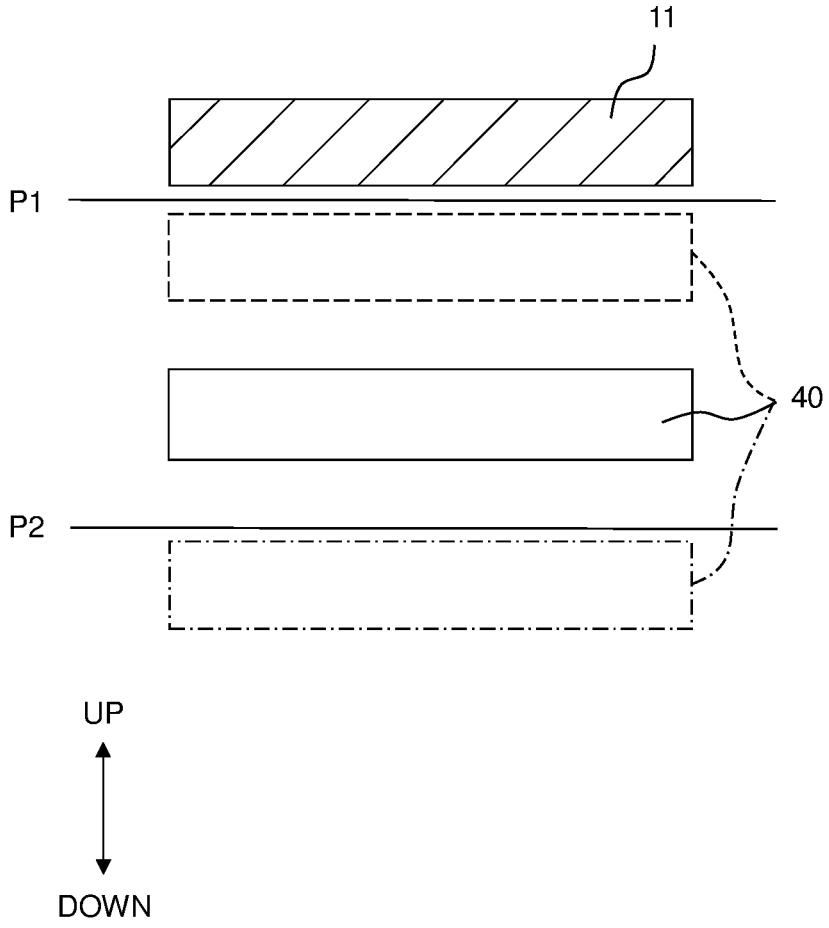
FIG. 8 is an explanatory view of the positional relationship between the movable suction unit and the head.

FIG. 8 is an explanatory view of the positional relationship between the movable suction unit 40 and the head 11. As indicated by broken lines in FIG. 8, in a case that only the movable suction unit 40 is moved upwardly and approaches closely to the head 11 as the maintenance target, the movable suction unit 40 moves upward up to an upper position P1. The movable suction unit 40 makes contact with the head 11 at the upper position P1. The upper position P1 corresponds to a "third position" of the present disclosure.

As indicated by dash-dot lines in FIG. 8, in a case that a pressurized purge is performed for the ink-jet head 4, Each of the movable suction units 40 and the fixed suction units 30 is arranged at a lower position P2. Although FIG. 8 depicts only the movable suction unit 40, the fixed suction units 30 are also arranged at the lower position P2, similarly to the movable suction units 40. Namely, unlike the above-described state regarding the upper position P1, not only the movable suction unit 40 is moved upward, but the movable suction units 40 and the fixed suction units 30 are arranged at the same position. The term "pressurized purge" indicates such an operation wherein the pressurized pump 15 (see FIG. 3) is driven so as to apply pressure to the reservoir 12, thereby discharging, from the entirety of the plurality of heads 11, a liquid containing air bubble(s). By the pressurized purge, it is possible to exhaust the air bubble(s) present in the nozzles 11*a*, and to perform the maintenance for the entirety of the plurality of heads 11. The entirety of the plurality of heads 11 receive the liquid discharged by the pressurized purge. The lower position P2 corresponds to a "fourth position" of the present disclosure.

As indicated by solid lines in FIG. 8, in a case that a flushing is performed for the ink-jet head 4, each of the movable suction units 40 and the fixed suction units 30 is arranged at a position between the upper position P1 and the lower position P2. Although FIG. 8 depicts only the movable suction unit 40, the movable suction units 40 and the fixed suction units 30 are arranged at the same position. The term "flushing" indicates such an operation wherein the liquid is discharged from the nozzles 11*a* of the entirety of the plurality of heads 11 so as to prevent any drying of the nozzles 11*a*. By performing the flushing, it is possible to perform the maintenance for the entirety of the plurality of heads 11. The flushing is performed at an initial discharge of the heads 11. By the flushing, the liquid in a mist-like state is discharged from the nozzles 11*a*. Although the liquid in the mist-like state easily dissipates or spreads, the movable suction units 40 and the fixed suction units 30 are capable of receiving the liquid in the mist-like state in a more assured manner by allowing the movable suction units 40 and the fixed suction units 30 to approach more closely to the heads 11 than the lower position P2.

Since the maintenance is executed by allowing the movable suction unit 40 to approach closely only to the maintenance target, it is possible to prevent any malfunction and/or inconvenience from occurring in a head 11 which does not require the maintenance. In such a case that the maintenance is executed for the head 11 which does not require the maintenance, there is such a fear that a liquid film formed in the nozzles 11*a* of the head 11 might be destroyed and any air and/or dust, dirt and/or debris, etc. might enter into the nozzles 11*a*, which in turn might lead to any malfunction, etc. By performing the maintenance only for the head 11 which requires the maintenance, it is possible to avoid such a malfunction, etc.

It should be understood that the embodiments disclosed above is exemplary but not limitary in each and every aspect. It is possible to combine the technical characteristics described in the respective embodiments with one another. The scope of the present disclosure is intended to include all scopes equivalent to those of the appended claims, and all changes without departing from the true spirit and scope of the present disclosure.

What is claimed is:

1. A liquid discharge apparatus comprising:

a plurality of heads configured to discharge a liquid; and a maintenance unit movable in a first direction between a first position at which the maintenance unit faces the plurality of heads and a second position at which the maintenance unit does not face the plurality of heads, and configured to perform maintenance for the plurality of heads in a case that the maintenance unit is located at the first position, wherein the maintenance unit includes a plurality of suction units corresponding to the plurality of heads, respectively, and a base unit to which the plurality of suction units are attached, wherein the plurality of suction units include a movable suction unit and a fixed suction unit, wherein in the case that the maintenance unit is located at the first position, the movable suction unit is movable in a second direction, which crosses the first direction and which is a direction approaching closely to or separating away from the plurality of heads, and wherein the fixed suction unit is fixed to the base unit so that the fixed suction unit is not movable in the second direction relative to the base unit.

2. The liquid discharge apparatus according to claim 1, wherein the movable suction unit is arranged at an end part of the maintenance unit in the first direction, the end part of the maintenance unit in the first direction being closer to the first position than another end part of the maintenance unit in the first direction.

3. The liquid discharge apparatus according to claim 1, further comprising a driving part connected to the movable suction unit and configured to drive the movable suction unit in the second direction.

4. The liquid discharge apparatus according to claim 3, wherein the driving part is an air cylinder.

5. The liquid discharge apparatus according to claim 4, further comprising a sealing member sealing a connection part at which the air cylinder and the movable suction unit are connected to each other, the sealing member being expandable and contractable in an axis direction of an axis of the air cylinder.

6. The liquid discharge apparatus according to claim 4, further comprising a speed regulator for an operating speed of the air cylinder.

7. The liquid discharge apparatus according to claim 4, wherein the maintenance unit has a plate connected to the air cylinder, and the liquid discharge apparatus further comprises:

a first stopper configured to regulate movement in the second direction of the plate in the direction approaching closely to the plurality of heads; and a second stopper configured to regulate movement in the second direction of the plate in the direction separating away from the plurality of heads.

8. The liquid discharge apparatus according to claim 7, wherein the plate includes a groove through which the liquid is exhausted.

9. The liquid discharge apparatus according to claim 1, wherein the maintenance unit is configured to perform a pressurized purge in a case that a purge is to be performed for the entirety of the plurality of heads.

10. The liquid discharge apparatus according to claim 9, further comprising a pump configured to apply pressure to the entirety of the plurality of heads, wherein the pump is driven so as to discharge the liquid from the entirety of the plurality of the heads.

11. The liquid discharge apparatus according to claim 9, wherein the movable suction unit is movable in the second direction between a third position at which the movable suction unit makes contact with at least one head among the plurality of heads in the second direction, and a fourth position at which the movable suction unit receives the liquid exhausted by the pressurized purge, and in a case that a flushing is to be performed for the plurality of heads by driving the plurality of heads to discharge the liquid from the plurality of heads, the movable suction unit is arranged between the third and fourth positions in the second direction.

12. The liquid discharge apparatus according to claim 1, wherein a wiper is provided adjacent to the movable suction unit in the first direction.

* * * * *